US008849503B1

(12) United States Patent
Dudar

(10) Patent No.: US 8,849,503 B1
(45) Date of Patent: Sep. 30, 2014

(54) PCM WAKE-UP STRATEGY FOR EVAP LEAKAGE DETECTION

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/942,061

(22) Filed: Jul. 15, 2013

(51) Int. Cl.
*F02M 25/00* (2006.01)
*F02M 25/08* (2006.01)

(52) U.S. Cl.
CPC ..... *F02M 25/0809* (2013.01)
USPC ..... 701/34.4; 701/32.3; 701/32.4

(58) Field of Classification Search
USPC ..... 701/29.1, 32.3, 32.4, 31.1, 31.2, 31.6, 701/32.7, 36, 468, 522; 180/65.1–65.8
See application file for complete search history.

(56) References Cited

U.S. PATENT DOCUMENTS

| | | | | |
|---|---|---|---|---|
| 6,082,337 | A * | 7/2000 | Fujimoto et al. | 123/520 |
| 6,089,081 | A * | 7/2000 | Cook et al. | 73/114.39 |
| 6,131,550 | A * | 10/2000 | Fritz et al. | 123/520 |
| 8,560,167 | B2 * | 10/2013 | Jentz et al. | 701/32.7 |
| 8,725,347 | B2 * | 5/2014 | Jentz et al. | 701/32.7 |
| 2011/0071721 | A1 * | 3/2011 | Gilfillan et al. | 701/30 |

* cited by examiner

*Primary Examiner* — Richard Camby
(74) *Attorney, Agent, or Firm* — Joseph E. Root

(57) ABSTRACT

A method for detecting leakage within an Evaporative Emission Control System (EVAP) of a vehicle continuously obtains the weather information and the weather forecast for the geographical location that the vehicle is currently in. Based on the weather information, an average time required for the fuel within the fuel-tank of the vehicle to cool off to a pre-determined temperature is calculated. The powertrain control module of the vehicle is activated at a specific instant, based on the average time, to perform the leakage detection within the EVAP system.

6 Claims, 2 Drawing Sheets

PCM WAKE-UP STRATEGY FOR EVAP LEAKAGE DETECTION

TECHNICAL FIELD

Embodiments of the present disclosure generally relate to Evaporative Emission Control Systems (EVAP) for automotive vehicles, and, more specifically, to methods and systems for detecting leakage within EVAP systems.

BACKGROUND

The fuel contained within the fuel-tank and fuel lines of an automotive vehicle may evaporate, releasing volatile organic compounds in the form of hydrocarbon vapor. That vapor may escape to the atmosphere, causing pollution in the form of evaporative emissions. Due to stringent air quality standards in the United States and other countries, automobile manufacturers constantly work to decrease evaporative emissions through the modern automobiles manufactured and introduced in the market.

Most modern vehicles incorporate an Evaporative Emission control system (EVAP) configured to reduce or minimize evaporative emissions. An EVAP system principally works by trapping and storing hydrocarbon vapors emerging from the fuel-tank, in a canister containing adsorbent carbon (carbon canister), and eventually, reintroducing the stored vapors to the engine, for combustion. Specifically, a fluid flow line links the fuel tank and the carbon canister, allowing vapor to flow to the canister from the tank. A second fluid flow line links the canister and the engine. A canister purge valve (CPV) is positioned in the second fluid line, and that valve is normally closed. The vehicle's Powertrain Control Module (PCM) opens the CPV at specific times, when the engine is running. As the CPV is opened, fresh air is drawn from the canister to the engine, entraining vapors stored within the canister and introducing them into the engine for combustion. That process is known as 'purging' the canister.

Any leakage within an EVAP emission system of a vehicle may contribute significantly to pollution. Therefore, the EVAP system should be completely leakage free. Regulations introduced by the Onboard Diagnostic system Generation II (OBD II) require that the EVAP systems should be checked for leaks as small as 0.02 inches in diameter.

Some OEMs do not commence the EVAP leak detection process until sufficient fuel cooling has occurred to create a natural vacuum within the system. Such cooling can require several hours, and thus some methods of leak detection require waking up the PCM arbitrarily, hours after the engine shutoff. Running tests at such times can require excess battery and system cycling, as well as incurring operator issues. For hybrid electric vehicles (HEV's), wasting battery power has a significant impact, as reductions in battery charge levels translate directly to reduced range on electric power. That effect requires additional operation of the combustion engine, which in turn directly impacts overall fuel economy. Thus, a small event can have serious consequences.

Considering the problems mentioned above, and other shortcomings in the art, there exists a need for an appropriate system and a method for performing leakage detection within the EVAP system of an automotive vehicle, which can activate the PCM at an appropriate time for detecting leakage.

SUMMARY

The present disclosure provides an efficient method and a system for detecting leakage within an evaporative emission control system (EVAP) of an automotive vehicle, wherein the appropriate time to perform the leakage detection is identified using local weather conditions and weather forecast for the geographical location that the vehicle is driven in.

According to an aspect of the disclosure, the method for detecting leakage within an EVAP system of a vehicle includes continuously obtaining the weather information and the weather forecast of the geographical location that the vehicle is currently in. The weather forecast is obtained for a specific pre-determined time. Based on the obtained weather information and the weather forecast, the method calculates an average time required for the fuel within the fuel-tank of the vehicle to cool down to a pre-determined temperature. The powertrain control module of the vehicle is then activated to perform the leakage detection within the EVAP system, based on the average time.

Additional aspects, advantages, features and objects of the present disclosure would be made apparent from the drawings and the detailed description of the illustrative embodiments construed in conjunction with the appended claims that follow.

DETAILED DESCRIPTION OF ILLUSTRATIVE EMBODIMENTS

Figure 1:
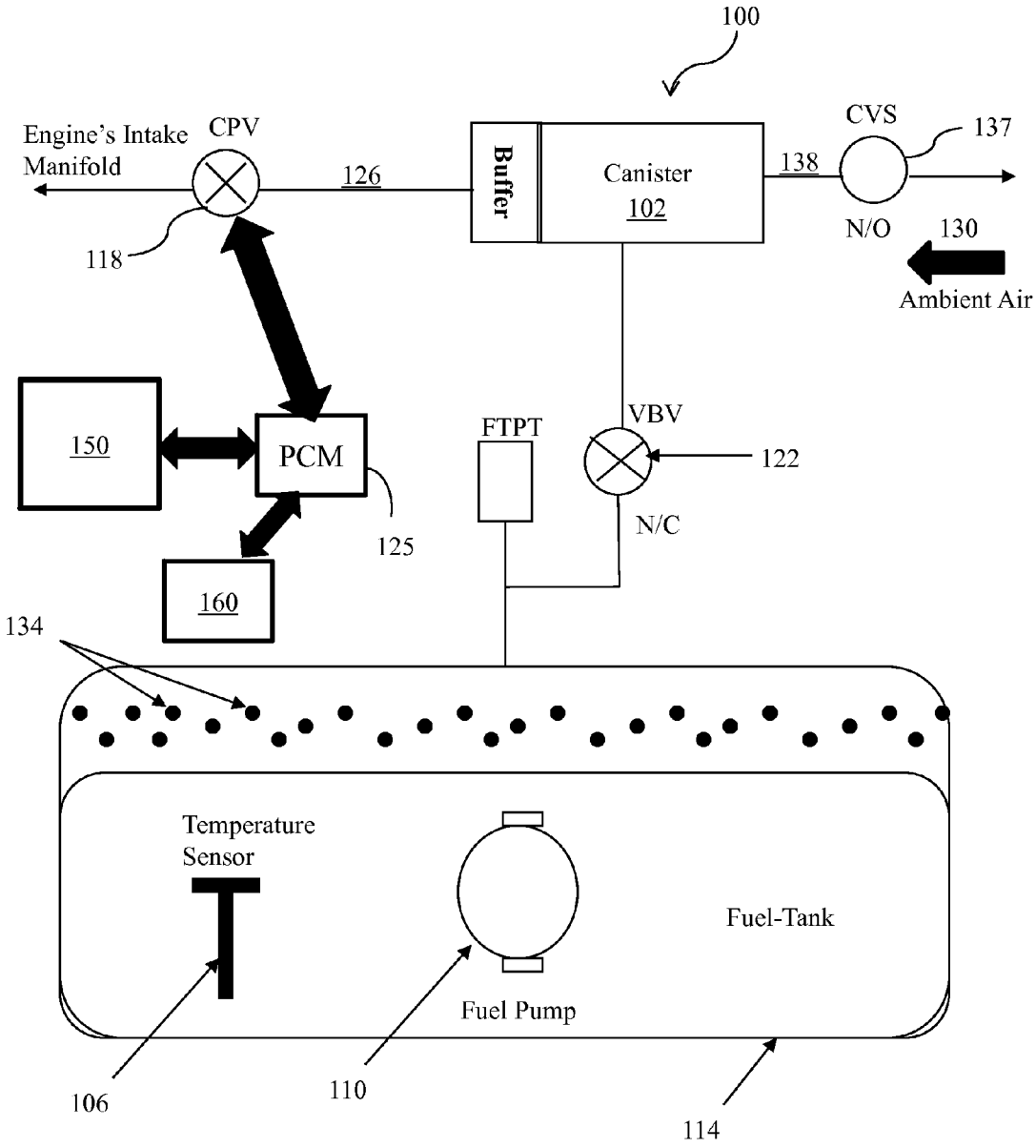
FIG. 1 is a schematic diagram representing the EVAP system for a vehicle, showing a powertrain control module coupled to a weather determination module, according to an embodiment of the present disclosure.

The following detailed description illustrates aspects of the disclosure and its implementation. This description should not be understood as defining or limiting the scope of the present disclosure, however, such definition or limitation being solely contained in the claims appended hereto. Although the best mode of carrying out the invention has been disclosed, those in the art would recognize that other embodiments for carrying out or practicing the invention are also possible.

As mentioned above, diurnal temperature variations cause fuel within a vehicle fuel-tank to vaporize. This effect produces volatile organic compounds in the form of hydrocarbon vapor, which escape into the atmosphere, causing pollution. Earlier Positive Crankcase ventilation (PCV) systems in the 1960's worked by capturing the crankcase vapors and preventing them from escaping the atmosphere by the use of road draft tubes. However, introduction of the combustible gases in the crankcase could cause a substantial increase in the pH value of the oil in the engine, resulting in an accelerated wear of components such as the seals and the bearings, and therefore, the PCV systems were not a permanent solution to minimize evaporative emissions.

As a replacement to PCV systems, modern vehicles incorporate Evaporative Emission Control Systems (EVAP), which principally work by adsorbing fuel vapor into activated carbon within a canister. The carbon canister is coupled to the engine's intake manifold through a canister purge valve (CPV). The vehicle's powertrain control module (PCM) 'as is the opens and closes the CPV. At specific engine running conditions, the PCM opens the CPV, and fresh ambient air flows through the CPV to towards the engine intake manifold.

The air inflow entrains the vapor trapped within the carbon canister, and routes those vapors to the intake manifold, for combustion.

Any leakage within the EVAP system of a vehicle can increase evaporative emissions. Environmental regulations grow steadily tighter, as seen in the California regulations, which typically require less than about 500 mg of hydrocarbons released as vehicle evaporative emissions in a standard 3 day test. Given other sources of emissions, that standard effectively limits canister emissions to less than about 200 mg. Similarly, Euro 5/6 regulations enforce a limit of about 2 grams of evaporative emissions per day. Such stringent conditions demand a highly efficient, effective, and leakage-free evaporative emission control system.

Typically, many conventional EVAP leakage detection methods cannot start until the fuel has cooled sufficiently to create a vacuum within the fuel-tank. Lacking an effective means of predicting when the vehicle and its fuel will have sufficiently cooled, conventional methods have proved highly wasteful. Waking up the PCM arbitrarily, at random hours lapsing from the engine key-off time, by anticipating that the fuel might have cooled sufficiently within those hours, may be an inappropriate activation of the PCM. Waking up the PCM consumes battery power, and therefore, carrying out the EVAP leakage routine tests at inappropriate times may reduce the average expected life of the EVAP components.

The present disclosure provides an efficient method and a system for detecting leakage within the EVAP system of a vehicle, wherein the PCM is activated to initiate the leakage detection, based on the weather information, including the average weather forecast for the geographical location that the vehicle is in.

FIG. 1 shows an embodiment of an EVAP system for a vehicle, having a PCM coupled to a weather detection module incorporated within the vehicle. As shown, evaporative emission control system 100 is configured to facilitate purging fuel vapor from a carbon canister. The system includes a carbon canister 102, linked by vapor flow lines 126 with the engine's intake manifold. A normally closed vapor bypass valve (VBV) 122 lies in the line between the canister 102 and the fuel tank 114, and a canister purge valve 118, also normally closed, lies in the line between the canister 102 and intake manifold 115. A fresh air line 138, controlled by normally open canister valve solenoid (CVS) 137, opens to the atmosphere. A powertrain control module 125 is coupled to CPV 118, to command opening and closing the CPV 118.

A temperature sensor 106 is also positioned within fuel tank 114, to measure the temperature there. Though only one temperature sensor 106 is shown, multiple such sensors may be disposed within the fuel tank 114, to obtain a more precise measure of the temperature within the interior of the fuel tank 114.

Normally, the Evaporative emission control system 100 operates as follows. As noted above, CPV 118 and VBV 122 are normally closed. Thus, canister 102 is generally sealed off from both of the fuel tank 114 and the intake manifold 115. As the engine starts, the PCM 125 commands to open the CPV 118, and the suction created within intake manifold draws air through normally open CVS 137, through fresh air line 138 and canister 102, and then on through flow line 126 and CPV 118, and into intake manifold 115. As the fresh air passes through canister 102, hydrocarbons accumulated in the activated carbon are desorbed and entrained by the airflow. These hydrocarbons accompany the air into the intake manifold 115, and thence into the engine (not shown), where they are burned.

The PCM 125 is also coupled to a weather detection module 150, which may be an integral component of the vehicle's GPS system (not shown). In some embodiments, the weather detection module 150 may be an independent module configured to determine the weather conditions and render a periodic weather forecast for the geographical location in which the vehicle is driven. In other embodiments, the weather detection module 150 may be a software application installed within the mobile phone of the driver/occupant of the vehicle, or a built-in application within the vehicle, configured to obtain a weather forecast.

Before shutting down the vehicle, PCM 125 obtains the vehicle location, together with weather forecast information from the module 150. That temperature drops sufficiently to allow the formation of a partial vacuum within the fuel tank. A typical temperature reduction required for that development is about 8° C. PCM 125 obtains a local hour by hour local weather forecast, and a processor 160 coupled to the PCM 125 will uses the forecast, together with current weather conditions, to calculate the an estimated time required for the fuel in the fuel-tank 114 to cool by about 8° C. In performing this calculation, the processor 160 may take into account factors such as the amount of fuel contained within the fuel-tank 114, the current temperature of the fuel, which can be obtained through the temperature sensor 106 disposed within the fuel-tank, the mass of the particular vehicle, and the like.

It will be understood that a number of variations can be introduced into this process. For example, the 8° C. cooling level could be varied, based on further experimentation and local conditions. Those of skill in the art will understand that the process requires the generation of a partial vacuum within the EVAP system, and thus such persons will be able to obtain that result with an appropriate level of cooling. Also, processor 160 could be a standalone element, or it could be integrated into PCM 125. A number of such processors are available on a typical contemporary vehicle, and those of skill in the art will be able to employ existing capabilities effectively.

Once the estimated wait time is known, the PCM 125 is commanded to wake-up only when that time has lapsed after the engine key-off. For example, in a case where the engine is turned off at 6 p.m., and the processor 160 calculates that about 6 hours are required for the fuel temperature to drop down to the optimal temperature, then the PCM 125 will wake up at midnight, to carry out the leakage detection. As another example, if the engine is turned off at 8:00 a.m., and the weather forecast obtained through the module 150 indicates that the temperature is going to constantly rise for the next 9 hours, then the PCM 125 will not be scheduled to wake up until 5 p.m.

Figure 2:
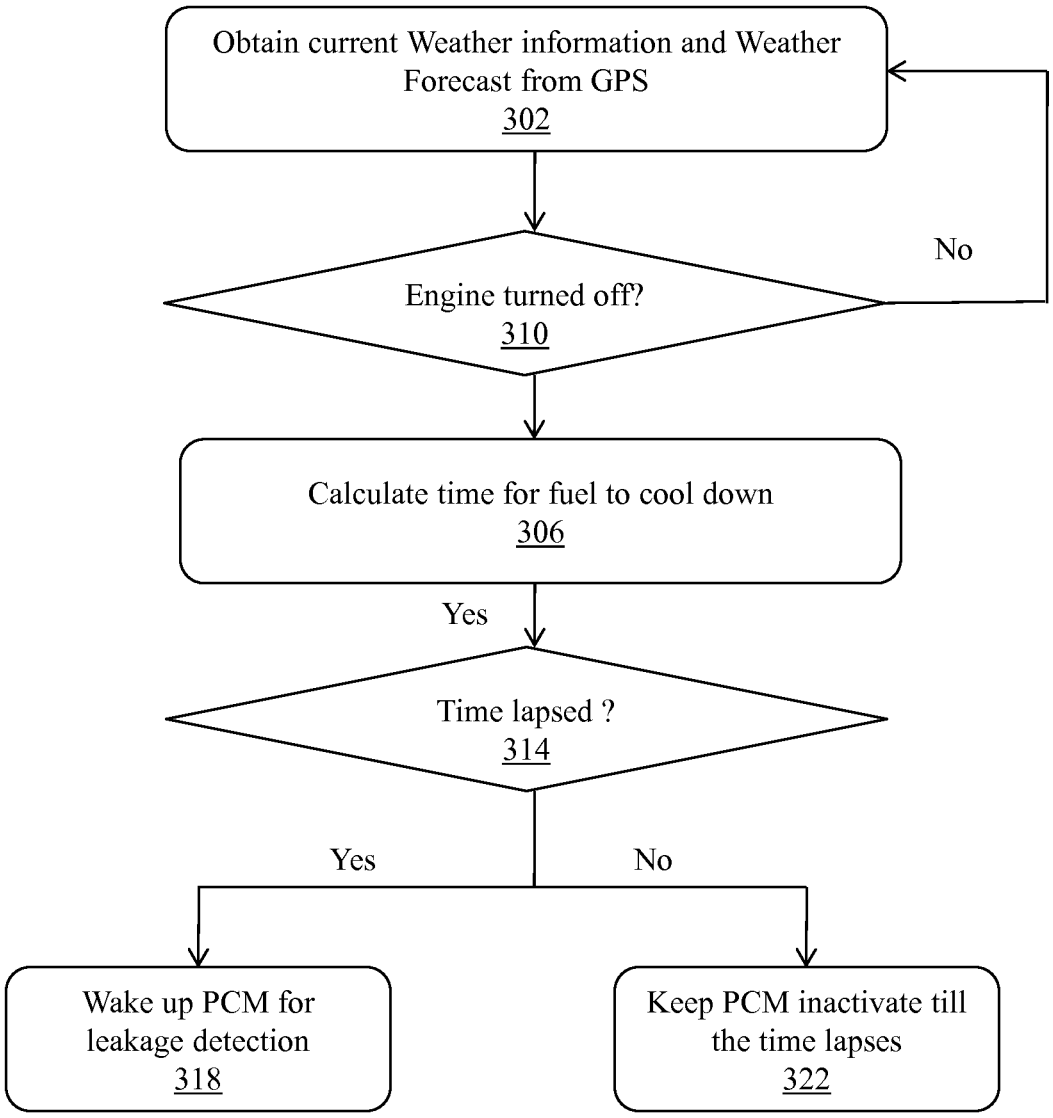
FIG. 2 is a flowchart depicting the different steps involved in detecting leakage within the EVAP system of a vehicle, in accordance with the present disclosure.

FIG. 2 is a flowchart depicting the steps involved in detecting leakage within an EVAP system of a vehicle, according to the present disclosure. Starting at step 302, the PCM obtains information about the current weather and the periodic weather forecast from the GPS or any another weather detection module integrated to the vehicle. As mentioned earlier, the PCM may also be coupled to a software application installed within the mobile phone of the driver of the vehicle, to obtain the weather information therefrom. At step 306, based on the weather information, the method calculates the average time required for the fuel within the tank to cool to the optimal temperature at which the PCM can be activated to initiate leakage detection. Parameters such as the amount of fuel contained within the fuel-tank and the current temperature of the fuel are taken into account to calculate that average temperature.

On calculating the average temperature, at step 310, the method waits for the vehicle to be turned off. At that time, the method begins iteratively checking whether the calculated average time has lapsed, at step 314. Once the average time has lapsed, the method activates the PCM at step 318, to carry out the EVAP leakage detection. Otherwise, the PCM is kept inactivated till the average time lapses, as shown in step 322. Further, if the weather information predicts that the ambient temperature is going to rise for certain hours after the engine is turned off, then the PCM is still kept inactivated before the ambient temperature starts falling down again.

The method and the system of the present disclosure avoids random activation of the PCM for EVAP leakage detection, and hence, saves battery power and avoids wearing of the different components of the EVAP system, such as the EVAP valves. Further, compared to the conventional leakage detection system, the idea does not require a snooze strategy for PCM if the fuel has not cooled down sufficiently, and incorporates the option of keeping the PCM dormant when the ambient temperature is anticipated to rise for hours after engine key-off, such as during the afternoon time.

Although the current invention has been described comprehensively, in considerable details to cover the possible aspects and embodiments, those skilled in the art would recognize that other versions of the invention are also possible.

What is claimed is:

1. A method for performing leakage detection within an evaporative emission control system of an automotive vehicle, comprising:

continuously obtaining current weather information and a weather forecast covering a predetermined time period, for the vehicle location;

calculating an expected fuel cooling time required for fuel within a vehicle fuel-tank to cool by a pre-determined amount; and activating a powertrain control module of the vehicle at the conclusion of the expected fuel cooling time, to perform the leakage detection within the evaporative emission control system.

2. The method of claim 1, wherein the current weather information and weather forecast include current and hourly forecasted temperature levels for the vehicle location.

3. The method of claim 1, where the predetermined amount of fuel tank cooling is about 8° C.

4. The method of claim 1, where the predetermined amount of fuel tank cooling sufficient to result in the formation of a partial vacuum within the fuel system.

5. The method of claim 1, wherein the calculating is performed by a processor.

6. The method of claim 5, wherein the processor is integrated with the powertrain control module.

* * * * *